US006386561B1

(12) United States Patent
Hanson

(10) Patent No.: US 6,386,561 B1
(45) Date of Patent: May 14, 2002

(54) LAMINATED SKATEBOARD WITH PROTECTIVE EDGE AND RACING BASE

(76) Inventor: Rolf R. Hanson, 4920 N. University Ave., #59, Provo, UT (US) 84604

( * ) Notice: Subject to any disclaimer, the term of this patent is extended or adjusted under 35 U.S.C. 154(b) by 0 days.

(21) Appl. No.: 09/596,839

(22) Filed: Jun. 19, 2000

(51) Int. Cl.[7] ..... B62M 1/00
(52) U.S. Cl. ..... 280/87.042; 280/610; 280/11.27
(58) Field of Search ..... 280/87.042, 87.041, 280/11.27, 610, 14.21

(56) References Cited

U.S. PATENT DOCUMENTS

| | | | |
|---|---|---|---|
| 4,044,083 | A | 8/1977 | Howe et al. |
| 4,165,089 | A | 8/1979 | Urdea et al. |
| 4,196,916 | A | 4/1980 | Schorr |
| 4,313,614 | A | 2/1982 | Woitschatzke et al. |
| 4,747,613 | A | 5/1988 | Brichoud et al. |
| 4,753,836 | A | 6/1988 | Mizell |
| 4,806,412 | A | 2/1989 | Wank et al. |
| 5,186,777 | A | 2/1993 | Perenon et al. |
| 5,221,105 | A | 6/1993 | Mayr et al. |
| 5,348,804 | A | 9/1994 | Vasselin et al. |
| 5,356,573 | A | 10/1994 | Kageyama |
| 5,372,370 | A | 12/1994 | Rohrmoser |
| 5,649,717 | A | 7/1997 | Augustine et al. |
| 5,716,562 | A | 2/1998 | Peart et al. |
| 5,759,664 | A | 6/1998 | Chisnell et al. |
| 5,848,800 | A | 12/1998 | Metzler et al. |
| 5,879,019 | A | 3/1999 | Mantel |
| 5,938,878 | A | 8/1999 | Hurley et al. |
| 5,997,018 | A | 12/1999 | Lee |
| RE36,586 | E | 2/2000 | Abondance et al. |

*Primary Examiner*—Donald P. Walsh
*Assistant Examiner*—James S. McClellan
(74) *Attorney, Agent, or Firm*—TraskBritt

(57) ABSTRACT

A laminated skateboard deck is disclosed including a top sheet with a high friction surface configured for direct contact with the shoes of a rider, a first layer of fiberglass in contact with the top sheet, a wood core in contact with the first layer of fiberglass, a second layer of fiberglass in contact with the wood core, a third layer of fiberglass in contact with the second layer of fiberglass, an aramid tissue layer in contact with the third layer of fiberglass, a racing base in contact with the third layer of fiberglass and a protective edge in contact with and encircling said racing base. The protective edge may be formed of a hard metal or plastic material. The laminated skateboard deck may also include protective plates protecting the nose and tail of the deck. Additionally, the laminated skateboard deck may include pre-drilled mounting holes or reinforced mounts for affixing truck assemblies.

20 Claims, 5 Drawing Sheets

LAMINATED SKATEBOARD WITH PROTECTIVE EDGE AND RACING BASE

BACKGROUND OF THE INVENTION

1. Field of the Invention

The present invention relates to a skateboard and, more particularly, to a skateboard constructed from materials to make a lightweight, yet durable skateboard for the modem day skateboarder.

2. State of the Art

It is generally accepted that the recreational sport of skateboarding developed as an offshoot of surfing sometime in the late 1960s. As such, the skateboard was, and still is, intended to provide an athletic experience similar to surfing. In recent years, the sport of skateboarding has become popular throughout the industrialized world. This acceptance of the sport is due in large part to technological developments which have improved the ride and handling of skateboards so that they better approximate the smooth ride of a surfboard on water.

A skateboard typically includes a board or platform to stand upon, 6–12 inches wide and 2–3 feet long. The terms "skateboard" and "board" are frequently used interchangeably among those of skill in the art. However, it should be noted that a complete skateboard typically includes a board, two trucks and four wheels. Herein, the term "skateboard" will refer to a complete skateboard, i.e., a board, two trucks and four wheels. The terms "board", "platform", "skateboard deck" and "deck" are used interchangeably herein and refer to the planar portion of a skateboard that the rider stands directly on and without trucks and wheels. Boards are often made of wood or fiberglass materials. The wheels of a skateboard are frequently comprised of polyurethane or other relatively soft rubber compounds. A truck typically includes a pivoting assembly with a single or split axle. For simplicity, the discussion herein will assume each truck has a single axle (hereinafter, axle). A truck assembly includes a truck and two wheels. Each truck assembly is typically mounted on the bottom side of the board, one truck assembly attached toward the front end of the board and the other truck assembly attached toward the rear end of the board. The pivoting assembly resiliently pivots about the truck's connection with the board and thereby displaces the axle from its usual orientation perpendicular to the median longitudinal axis of the skateboard. The axles are displaced by applying a downward force in the form of a rolling motion. The rolling motion tilts the board so that an imaginary line through each axle will intersect at the center of a circle. A skateboard when rolled in this manner is then guided along the circumference of the circle. This arrangement of wheels through the pivoting assembly of the trucks provides favorable cornering characteristics along with stability, enabling skilled skateboarders to negotiate smooth, sharp turns in rapid succession.

Conventional skateboards have been formed with a plurality of plies of sugar maple veneers, pressed together using polyvinyl glues. The veneers and glue that make up a board are pressed together in a press between forms of aluminum, metal or concrete. The forms allow for boards with various three dimensional shapes to be pressed together. The veneers and glue are subjected to pressures around 300 psi for a specified pressing time. Pressing times may range from about thirty minutes to about an hour. One closing of a press may be used to produce multiple skateboards in one press. It is not uncommon to produce three to five board blanks from a single laminated stock resulting from one press. After pressing the laminated stock is removed from the press. The laminated stock is allowed to cure, typically for a number of days. After curing, the three to five board blanks are cut with saws or routers, into the final shape of the board. Edge trimming, paint and other finishes may be added to the board before it is finished.

The performance of a board is related to two structural characteristics. The first characteristic is the topology of the board, i.e., the 3-dimensional curves that are in the board itself Curves may include concave nose, tail and other curvature. The second characteristic is the board's plan form or outline. The board's plan form or outline may be obtained by placing a board flat up against a flat surface and tracing its outline. Board topology with concave curves including an upturned nose and tail have been used in boards at least since the early 1980s. Such board topology both strengthens the board and gives the rider more control of the board.

The style of riding a skateboard dramatically changed with the introduction of a move known as the "ollie" and named for the rider who first used the move, Allen Ollie Gelfand. An ollie involves the combination of tapping the tail of the board down with the rear foot, while jumping in the air and kicking forward with the front foot. The proper execution of these actions results in the board jumping into the air with the rider. The advent of the ollie has led to even more sophisticated moves. Skateboard riders today have evolved the ollie and other more sophisticated moves into a completely new style of skateboarding known as "street skating". Street skating uses obstacles in the street to perform moves or "tricks" on, over, or against. However, many conventional skateboards cannot stand up to the rigors of street skating or the more traditional vertical skating on ramps or in pools.

One of the main problems facing vertical and street skaters is damage occurring to the board, especially the bottom surface of a board. The bottom surface comes into frictional contact with irregular surfaces because of vertical and street skating style. Such damage may result in a layer of a laminated board chipped away from the remaining layers. Frictional contact generally removes material from the board. Such damage reduces the long term use of the skateboard. Thus, a need exists in the art for a board that is more durable than conventional boards and that reduces damaging frictional contact with other objects during maneuvers performed by street skaters.

BRIEF SUMMARY OF THE INVENTION

The present invention relates to a laminated skateboard deck. In particular, the present invention concerns the manufacture of a skateboard being able to handle the rigors of vertical and street skaters performing rail slides, grinds, jumps and other sophisticated tricks.

The present invention is a laminated skateboard constructed using multiple layers, robust edges and a racing base to address the problems caused by vertical and street skateboarding. The laminated skateboard is lightweight, allowing riders to perform all of their standard tricks. Additionally, the laminated skateboard of the present invention is durable enough to handle the stresses of these tricks.

Embodiments of the laminated skateboard deck may include a protective peripheral edge formed of a hard metal or plastic material. Embodiments of the laminated skateboard deck may also include metal plates protecting the nose and tail of the deck. Additionally, the laminated skateboard deck may include pre-drilled mounting holes or reinforced mounts for affixing truck assemblies.

BRIEF DESCRIPTION OF THE DRAWING FIGURES

In the drawings, which illustrate what is currently regarded as the best mode for carrying out the invention and in which like reference numerals refer to like parts in different views or embodiments:

DETAILED DESCRIPTION OF THE INVENTION

Figure 1:
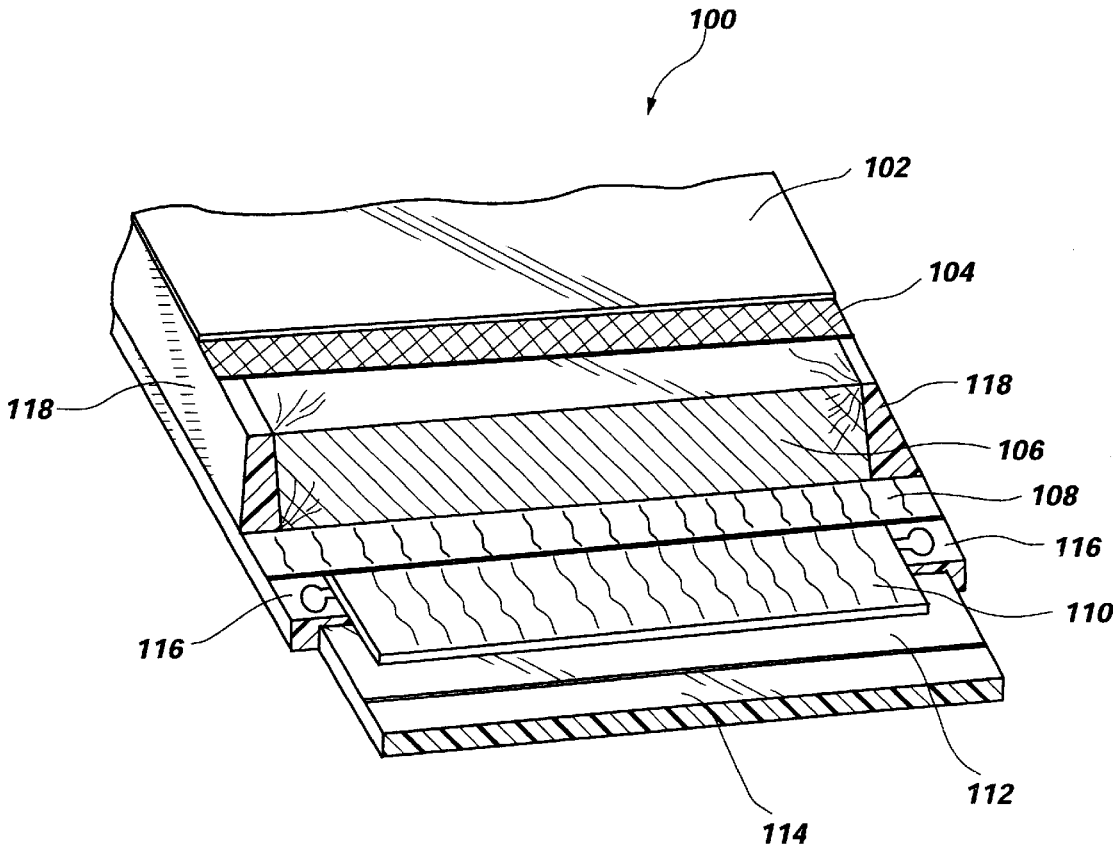
FIG. 1 is an illustrative, perspective cross-sectional view of an embodiment of the invention.

FIG. 1 illustrates, in perspective, a cross-sectional view of an embodiment of a laminated skateboard deck 100 in accordance with the invention. The deck 100 includes a top sheet 102, a first layer of fiberglass 104, a wood core 106, a second layer of fiberglass 108, a third layer of fiberglass 110, an aramid tissue layer 112, a racing base 114, protective edges 116 and side walls 118. The wood core 106 may be maple (shown), oak or other hard wood. The wood core 106 may also again as shown, be laminated layers of hard wood. First layer of fiberglass 104 and second layer of fiberglass 108 are preferably triaxial fiberglass. Third layer of fiberglass 110 is preferably biaxial fiberglass. The racing base 114 may be manufactured from any low friction plastic or plastic-like material, for example and not by way of limitation, ultra high molecular weight polyethylene, as known to one of ordinary skill in the art. The side walls 118 may be formed of ABS plastic or other similar material and are preferably in contact with the wood core 106 and in contact with and between the first fiberglass layer 104 and the second fiberglass layer 108.

Additionally, FIG. 1 shows a protective edge 116 surrounding the outside edge of the multi-laminate deck 100. Protective edges 116 are preferably formed of any suitable metal or metal alloy, for example and not by way of limitation, carbon steel, stainless steel, titanium and alloys thereof The protective edge 116 may alternatively be made of a hard plastic or plastic-like material. The protective edges 116 may be of two pieces each forming a lateral edge of the board 100. Alternatively, the protective edge 116 may be a single unified protective edge that circumscribes the entire circumferential rim of the board 100. In yet another embodiment, the protective edge 116 forms a single layer in the multilaminate deck with an upside-down "U" or "⊓" cross-section (as shown). The purpose of a metal edge 116 is to provide a protective surface for the board 100 when contact is made with the ground or other objects over which the board 100 is traversing during aggressive use. The protective edge 116 also provides additional support to the deck 100 and helps prevent chipping, cracking or delaminating of the skateboard deck 100. One advantage of deck 100 relative to conventional skateboard decks is that it produces a more durable deck for a skateboard or other wheeled footboard. Another advantage of deck 100 is the racing base 114 which allows the rider to perform skateboard maneuvers that include sliding over objects that come into contact with the racing base 114.

The skateboard deck 100 is also lightweight, which is preferable for aerial maneuvers and when transporting the deck by hand or in a backpack, for example. The top sheet 102 may be made formed with a coarse surface, or other high-friction surface treatment to help create more friction between a rider's shoe and the skateboard deck 100. Additionally, grip tape may be added to the top sheet 102 to provide a high friction surface. Grip tape, as commonly known to one of ordinary skill in the art, is a sandpaperlike material with an adhesive on the non-abrasive surface for adhering to a surface such as the top of a skateboard deck.

Figure 2:
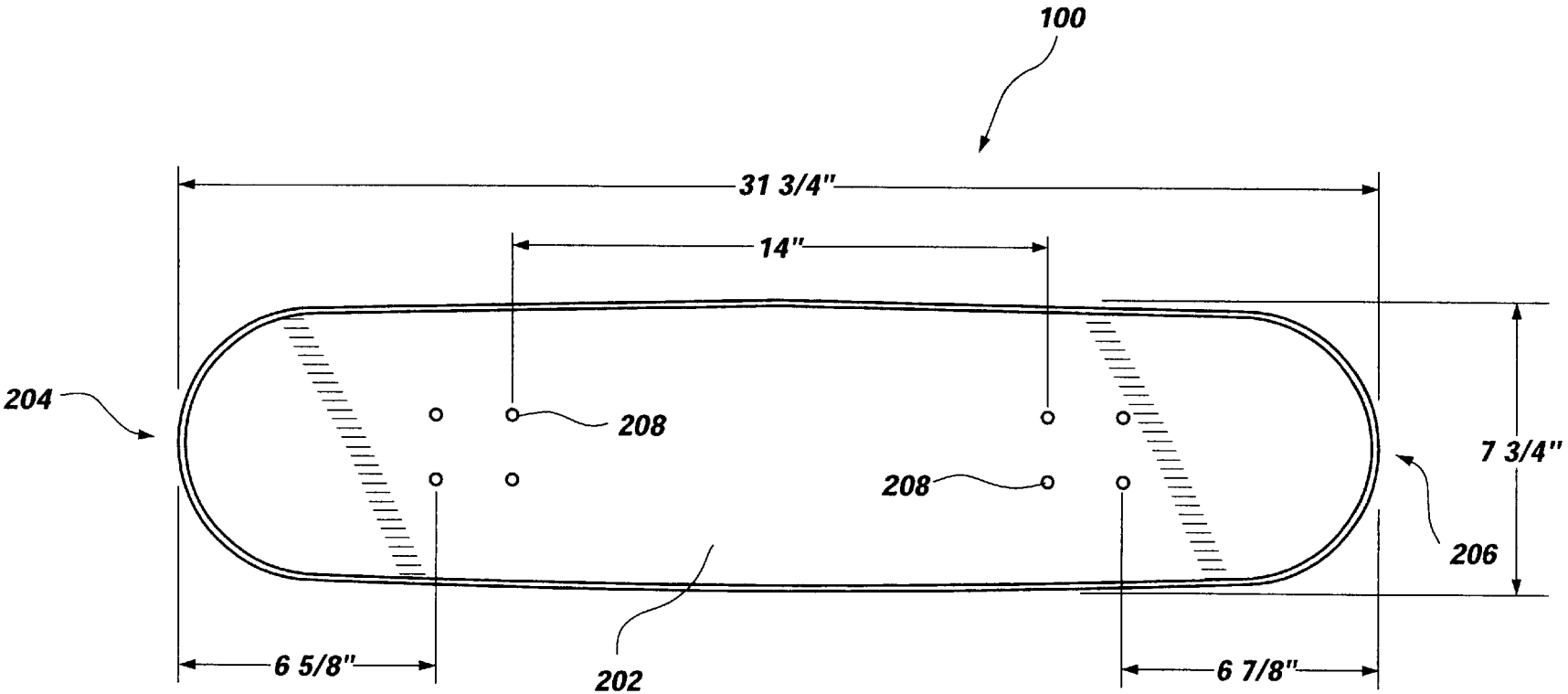
FIG. 2 is an bottom view of a preferred embodiment of a skateboard showing dimensions.

FIG. 2 illustrates a plan view of the bottom surface 202 of a skateboard deck 100 in accordance with the invention. The preferred dimensions for a skateboard deck 100 are also shown in FIG. 2. In FIG. 2, the tail 204 of skateboard deck 100 is shown on the left and the nose 206 is shown on the right. According to the preferred dimensions of the skateboard deck 100, the length of the tail 204, i.e., the distance from the edge of the tail 204 to the rear truck mounting holes, is about 6 ⅝". According to the preferred dimensions of the skateboard deck 100, the distance separating the rear and front truck mounting holes is about 14". According to the preferred dimension of the skateboard deck 100, the overall length of the skateboard deck 100 is about 31 ¾". According to the preferred dimensions of the skateboard deck 100, the length of the nose 206, i.e., the distance from the front truck mounting holes to the edge of the nose 206 is about 6 ⅞"

However, the dimensions of the skateboard deck 100 may be varied to suit the needs of the rider and/or the application of the skateboard (i.e., slalom racing, down-hill racing, aerial maneuvers, etc.). For example, the overall length may range from about 20" to about 50". Additionally, the width of the skateboard deck 100 may range from about 4" to about 12". The thickness of the skateboard deck 100 may range from about ⅜" to about ¾". Depending on the desired flex of the skateboard, the thickness of the deck 100 may be selected accordingly. The term "flex" is used herein to describe the deck's elastic deformability, i.e., the distance by which the rider's weight tends to "bow" the deck 100 when standing on the center of the deck and providing a torque relative to the trucks which are in contact with a rigid surface. The thicker the deck, the less flex will occur, i.e., a thick deck will have less flex.

FIG. 2 also illustrates a preferred placement for eight mounting holes 208 in the base of the deck. However, the placement of the mounting holes 208 may also be adjusted for particular rider preference. The mounting holes 208 may be spaced for any standard truck or customized as necessary. The skateboard deck 100 may be manufactured with pre-drilled mounting holes. Alternatively, the skateboard deck 100 may be manufactured and sold without mounting holes 208 for the trucks. In this case, the rider may select precisely where to place the trucks. The mounting holes 208 may be drilled using any conventional means known to one of ordinary skill in the art. Mounting holes 208 may be through-holes. Conventional nuts and bolts may be used with through-hole mounting holes 208 to secure the trucks. Alternatively, mounting holes 208 may be replaced with reinforced mounts (not shown) that do not pass completely through the skateboard deck 100 (see 532 of FIG. 5 and related discussion below).

Skateboard deck 100 may be entirely substantially planar. Alternatively, skateboard deck 100 may be substantially planar in a mid-section located between and including the front and rear sets of mounting holes 208 and curvilinear elsewhere. For example, the nose 206 and the tail 204 each may be sloped away from the substantially planar mid-section to allow the rider to tip the skateboard in various maneuvers. Alternatively, only the tail 204 may be formed with a curved topology that bends away from the mid-section. In yet another embodiment the skateboard deck 100 may be precambered, i.e., slightly convex, with upturned nose and tail. In still yet another embodiment, the skateboard deck 100 may include a slightly concave mid-section with none, one or both of the nose and tail upturned.

Figure 3:
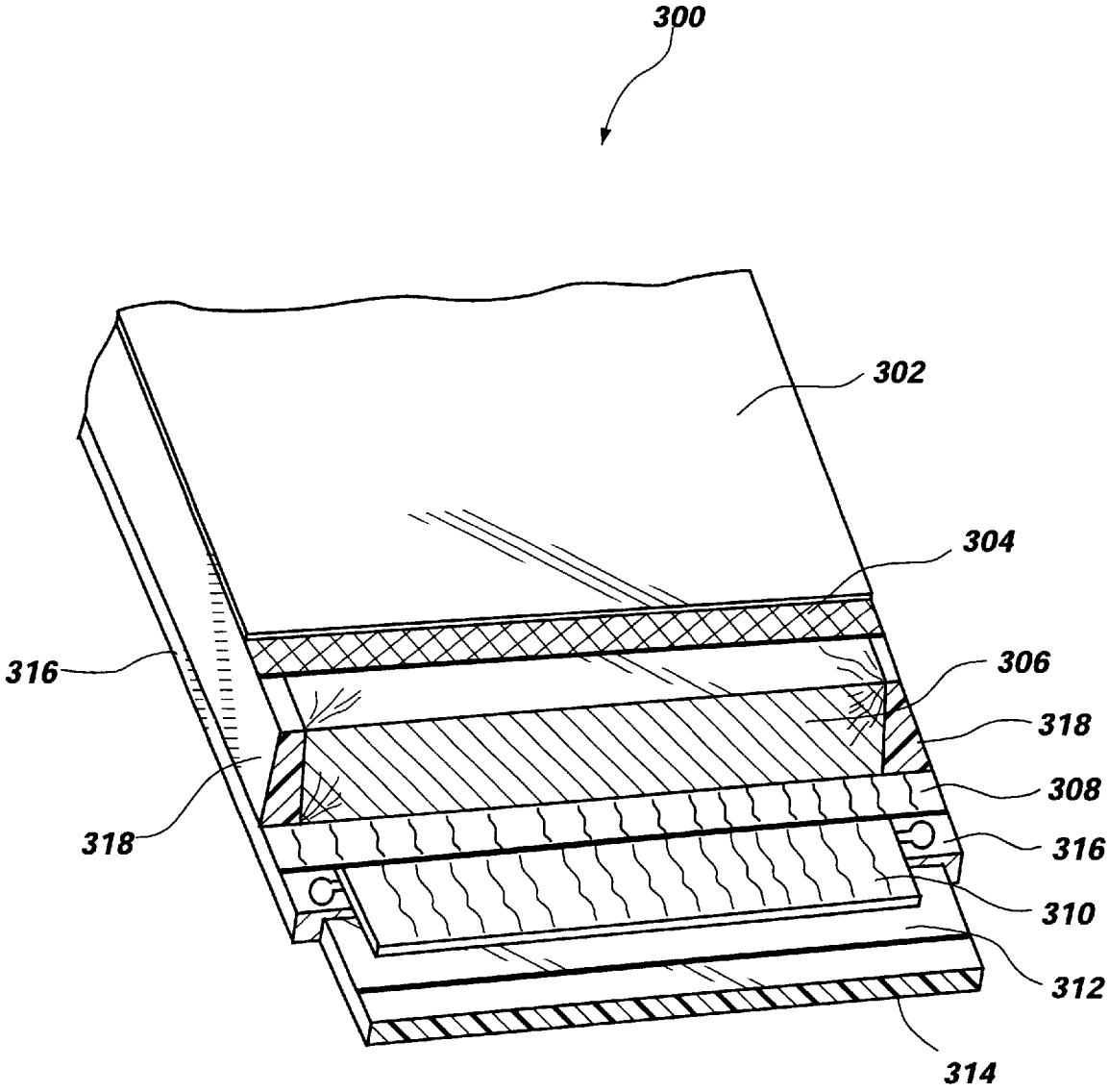
FIG. 3 is an illustrative cross-sectional view of another embodiment of the invention.

FIG. 3 illustrates another embodiment of a laminated skateboard deck 300 in accordance with the present invention. Laminated skateboard deck 300 includes a rough surface top sheet 302, a first fiberglass layer 304, a wood core 306, a second layer of fiberglass 308, a third layer of fiberglass 310, an aramid tissue layer 312, a racing base 314, protective edges 316 and side walls 318. The wood core 306 may be maple, oak or other hard wood. The wood core 306 may also be laminated layers of hard wood. The first layer of fiberglass 304 and second layer of fiberglass 308 are preferably triaxial fiberglass. The third layer of fiberglass 310 is preferably biaxial fiberglass. The racing base 314 may be manufactured from any low friction plastic or plastic-like material, for example and not by way of limitation, ultra high molecular weight polyethylene, as known to one of ordinary skill in the art. The racing base 314 provides a low friction surface to assist in gliding over objects and obstacles during skateboard maneuvers that cause the bottom of the skateboard deck 300 to come into contact with such objects and obstacles. The protective edge 316 may be formed of steel or a hard plastic material to reinforce the wood core 306. The protective edge 316 may encircle the entire skateboard deck 300. Alternatively, the protective edge 316 may comprise a single layer of the skateboard deck 300, with an upside-down "U" or "⊓" cross-section. The protective edge 316 helps reinforce the edges of the skateboard deck 300 during skateboard maneuvers that cause the edges of the skateboard deck 300 to come into contact with objects and surfaces such as curbs and asphalt.

The various layers described are representative of materials from which the skateboard decks 100 and 300 may be constructed. One of ordinary skill in the art will recognize that other comparable materials may be substituted for one or more of the described layers without departing from the scope of the invention.

Figure 4:
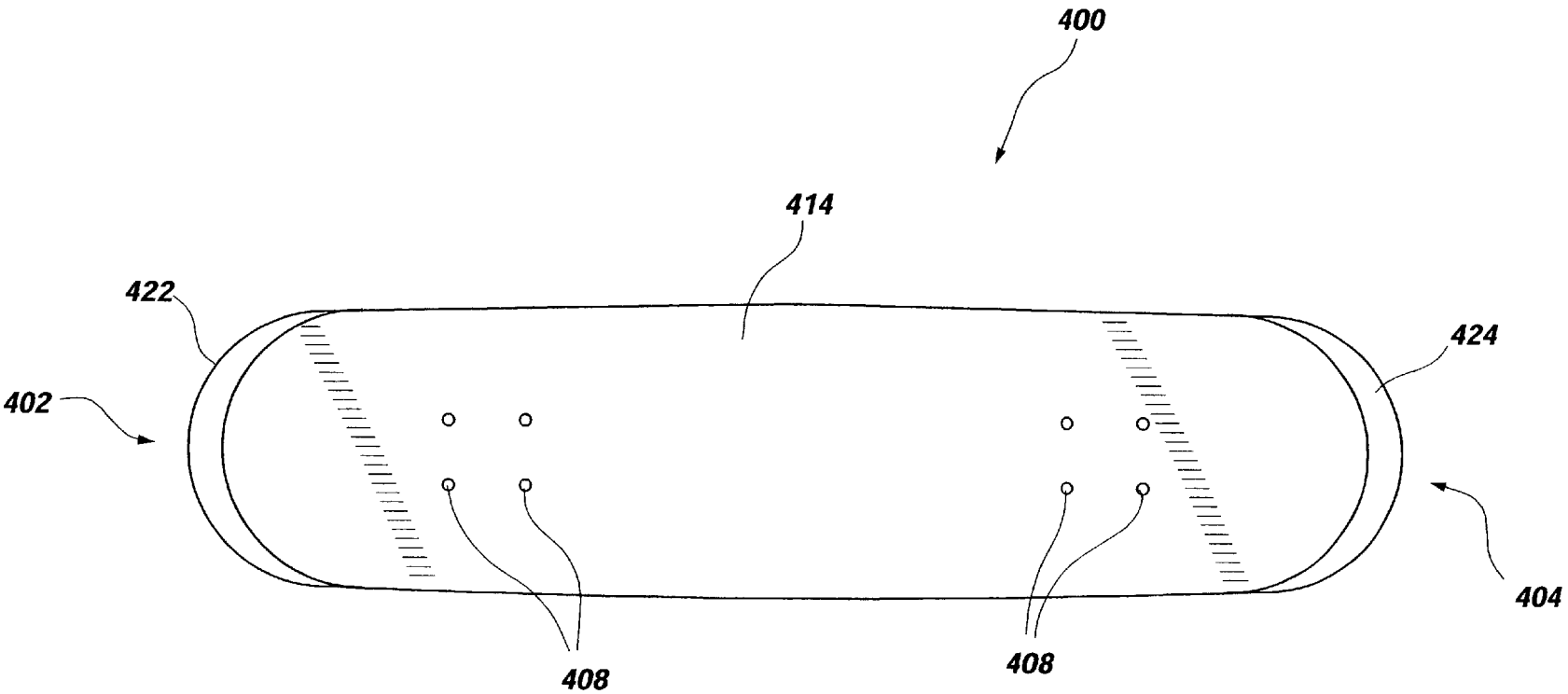
FIG. 4 is a bottom view of yet another skateboard constructed according to the present invention.

FIG. 4 illustrates a plan view of the bottom surface of yet another embodiment of the skateboard deck 400 in accordance with the invention. FIG. 4 illustrates a racing base 414 surrounded at the tail 402 and nose 404 by a rear protective plate 422 and a front protective plate 424, respectively. Protective plates 422 and 424 may be formed of any suitable metal or metal alloy, for example and not by way of limitation, carbon steel, stainless steel, titanium and alloys thereof. Alternatively, protective plates 422 and 424 may be formed of a hard plastic or plastic-like material. The protective plates 422 and 424 provide protection for the racing base 414 by reducing wear during contact with riding surfaces. The protective plates 422 and 424 are configured for placement on and substantially around the nose 404 and tail 402 of the skateboard deck 400. The protective plates 422 and 424 may be adhered to the nose 404 and tail 402 of the skateboard deck 400 using any means known to one of ordinary skill in the art.

Also shown in FIG. 4 are optional pre-drilled holes 408 in the base of the deck. These pre-drilled holes 408 may pass completely through skateboard deck 400. Alternatively, pre-drilled holes 408 may include reinforced mounts (not shown in FIG. 4 for clarity, but illustrated as 532 in FIG. 5) for accepting mounting bolts (also not shown in FIG. 4 for clarity, but illustrated as 530 in FIG. 5) in a threaded coupling. Placement of the pre-drilled holes 408 may vary in distance from the nose 404 or tail 402 of the skateboard deck 400 depending on the preference of the rider. Skateboard deck 400 may also include protective edges along the exposed edges of deck 400 in between the protective plates 422 and 424.

Figure 5:
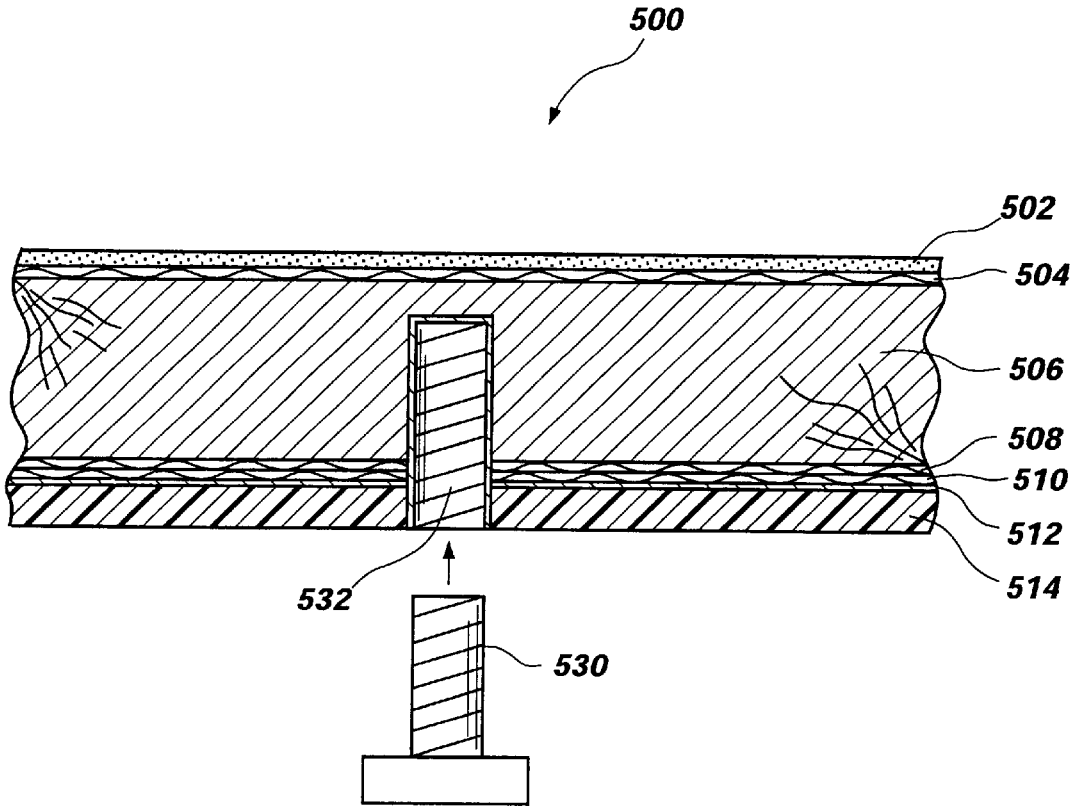
FIG. 5 is a side view of even yet another embodiment of a skateboard deck illustrating reinforced mounts according to the present invention.

FIG. 5 illustrates a cross-sectional view of even yet another embodiment of a skateboard deck 500 in accordance with the present invention. FIG. 5 shows a portion of a side view of a skateboard deck 500 including various layers, specifically, a top sheet 502, a first layer of fiberglass 504, a wood core 506, a second layer of fiberglass 508, a third layer of fiberglass 510, an aramid tissue layer 512, and a racing base 514. The layers illustrated in FIG. 5 are not necessarily shown to scale. FIG. 5 also shows a single reinforced mount 532 which is configured to attach trucks with a threaded bolt 530 for threadedly engaging the reinforced mount 532. The reinforced mounts 532 provide additional reinforcing to the skateboard deck 500 that ordinary through hole mounting holes 208 (see FIG. 2) do not provide. The trucks (not shown) may be secured to the skateboard deck with a screw driver, wrench or other bolt engaging tool known to one of skill in the art. One advantage to using reinforced mounts 532 is that bolt heads will protrude from the top of the skateboard deck 500, thus improving surface friction between the top surface of deck 500 and the rider's shoes. Additionally, the use of reinforced mounts 532 is simpler than a conventional nuts and bolts mounting scheme because only a threaded bolt 530 rather than a nut and bolt is required. Each of two trucks (not shown for clarity) will normally be attached with four threaded bolts 530.

Although this invention has been described with reference to particular embodiments, the invention is not limited to these described embodiments. Rather, the invention is limited only by the appended claims, which include within their scope all equivalent devices or methods that operate according to the principles of the invention as described.

What is claimed is:

1. A laminated skateboard deck comprising:

a top sheet with a high friction surface configured for direct contact with the shoes of a rider;

a first layer of fiberglass in contact with said top sheet;

a wood core in contact with said first layer of fiberglass;

a second layer of fiberglass in contact with said wood core;

a third layer of fiberglass in contact with said second layer of fiberglass;

an aramid tissue layer in contact with said third layer of fiberglass;

a racing base in contact with said aramid tissue layer; and a protective edge in contact with and encircling said racing base.

2. The laminated skateboard deck of claim 1, wherein said top sheet includes grip tape thereon.

3. The laminated skateboard deck of claim 1, wherein said first layer of fiberglass comprises triaxial fiberglass.

4. The laminated skateboard deck of claim 1, wherein said wood core is selected from the group including maple and oak.

5. The laminated skateboard deck of claim 1, wherein said second layer of fiberglass comprises triaxial fiberglass.

6. The laminated skateboard deck of claim 1, wherein said third layer of fiberglass comprises biaxial fiberglass.

7. The laminated skateboard deck of claim 1, wherein said racing base comprises a low-friction plastic.

8. The laminated skateboard deck of claim 1, wherein said racing base comprises polyethylene.

9. The laminated skateboard deck of claim 1, wherein said protective edge is selected from the group including carbon steel, carbon steel alloy, stainless steel, stainless steel alloy, titanium and titanium alloy.

10. The laminated skateboard deck of claim 1, wherein said protective edge comprises a hard plastic material.

11. The laminated skateboard deck of claim 1, wherein said deck is substantially planar in a mid-section and includes a nose and a tail each formed with a curved topology that bends away from said substantially planar mid-section.

12. The laminated skateboard deck of claim 1, further including pre-drilled mounting holes.

13. The laminated skateboard deck of claim 1, further including reinforced mounts, said reinforced mounts not passing completely through said laminated skateboard deck.

14. The laminated skateboard deck of claim 1, further including side walls in contact with said wood core and in contact with and between said first fiberglass layer and said second fiberglass layer.

15. A laminated skateboard deck with a nose and a tail comprising:

a top sheet with a high friction surface configured for direct contact with the shoes of a rider;

a first layer of fiberglass in contact with said top sheet;

a wood core in contact with said first layer of fiberglass;

a second layer of fiberglass in contact with said wood core;

a third layer of fiberglass in contact with said second layer of fiberglass;

an aramid tissue layer in contact with said third layer of fiberglass;

a racing base in contact with said aramid tissue layer; and protective plates in contact with and substantially surrounding said nose and said tail.

16. The laminated skateboard deck of claim 15, further comprising a plurality of reinforced mounts, said reinforced mounts not passing completely through said laminated skateboard deck and configured to mate with threaded bolts to secure truck assemblies.

17. The laminated skateboard deck of claim 15, further including protective edges along exposed edges of said laminated skateboard deck and extending in between said protective plates.

18. A laminated skateboard including two truck assemblies coupled to a laminated skateboard deck, said laminated skateboard deck comprising:

a top sheet with a high friction surface configured for direct contact with the shoes of a rider;

a first layer of fiberglass in contact with said top sheet;

a wood core in contact with said first layer of fiberglass;

a second layer of fiberglass in contact with said wood core;

a third layer of fiberglass in contact with said second layer of fiberglass;

an aramid tissue layer in contact with said third layer of fiberglass;

a racing base in contact with said aramid tissue layer; and a protective edge in contact with and encircling said racing base.

19. The laminated skateboard of claim 18, wherein said laminated skateboard deck further includes a plurality of reinforced mounts, said reinforced mounts not passing completely through said laminated skateboard deck for securing said two truck assemblies with threaded bolts.

20. The laminated skateboard of claim 18, wherein said laminated skateboard deck further includes a nose and a tail and metal plates in contact with and substantially surrounding said nose and said tail.

* * * * *

UNITED STATES PATENT AND TRADEMARK OFFICE

CERTIFICATE OF CORRECTION

PATENT NO. : 6,386,561 B1
DATED : May 14, 2002
INVENTOR(S) : Rolf R. Hanson

It is certified that error appears in the above-identified patent and that said Letters Patent is hereby corrected as shown below:

Column 3,
Line 10, change “an” to -- a --
Line 32, change “First” to -- The first --
Line 33, change “Third” to -- The third --

Column 4,
Line 9, change “sandpaperlike” to -- sandpaper-like --

Signed and Sealed this

Twenty-fourth Day of February, 2004

JON W. DUDAS
*Acting Director of the United States Patent and Trademark Office*